US007849796B2

(12) United States Patent
Trudeau et al.

(10) Patent No.: US 7,849,796 B2
(45) Date of Patent: Dec. 14, 2010

(54) WEB OFFSET PRINTING PRESS WITH ARTICULATED TUCKER

(75) Inventors: Bradford John Trudeau, Lee, NH (US); Brian Joseph Gentle, Rochester, NH (US); Bryan Charles Dustin, Strafford, NH (US)

(73) Assignee: Goss International Americas, Inc, Durham, NH (US)

( * ) Notice: Subject to any disclaimer, the term of this patent is extended or adjusted under 35 U.S.C. 154(b) by 0 days.

(21) Appl. No.: 11/388,602

(22) Filed: Mar. 24, 2006

(65) Prior Publication Data

US 2006/0219116 A1 Oct. 5, 2006

Related U.S. Application Data

(60) Provisional application No. 60/666,439, filed on Mar. 30, 2005.

(51) Int. Cl.
*B41F 27/00* (2006.01)

(52) U.S. Cl. ..... 101/477; 101/247; 101/415.1

(58) Field of Classification Search ..... 101/247, 101/477

See application file for complete search history.

(56) References Cited

U.S. PATENT DOCUMENTS

| | | | | |
|---|---|---|---|---|
| 2,172,364 | A | 9/1939 | De Manna | 271/80 |
| 3,527,165 | A | 9/1970 | Harless | 101/143 |
| 4,240,346 | A | 12/1980 | Landis et al. | 101/139 |
| 4,458,591 | A | 7/1984 | Guaraldi | 101/247 |
| 4,620,480 | A | 11/1986 | Hermach | 101/179 |
| 4,677,911 | A | 7/1987 | Hermach | 101/218 |
| 4,807,527 | A | 2/1989 | Knauer | 101/216 |
| 4,823,693 | A | 4/1989 | Koebler | 101/218 |
| 4,831,926 | A | 5/1989 | Bowman et al. | 101/138 |
| 4,875,936 | A | 10/1989 | Hermach | 101/218 |
| 4,913,048 | A | 4/1990 | Tittgemeyer | 101/141 |
| 4,932,321 | A | 6/1990 | Hermach | 101/211 |
| 4,934,265 | A | 6/1990 | Knauer | 101/177 |
| 5,003,889 | A | 4/1991 | Glunz et al. | 101/228 |
| 5,005,475 | A | 4/1991 | Knauer | 101/218 |
| 5,042,788 | A | 8/1991 | Bowman et al. | 270/21.1 |
| RE33,944 | E | 6/1992 | Knauer | 101/216 |

(Continued)

FOREIGN PATENT DOCUMENTS

| | | |
|---|---|---|
| DE | 2046131 | 3/1972 |

(Continued)

OTHER PUBLICATIONS

Mike Thompson, Sunday 2000—Auto Transfer "Zero Makeready Format" WOA Conference, Nashville, TN May 7, 2003, pp. 1-14.

(Continued)

*Primary Examiner*—Jill E Culler
(74) *Attorney, Agent, or Firm*—Davidson, Davidson & Kappel, LLC

(57) ABSTRACT

An offset web print unit includes a plate cylinder, a blanket cylinder, the plate cylinder being movable during a throw-off operation, and a tucker bar for tucking plates into the plate cylinder, the tucker bar having an axis movable with respect to the plate cylinder axis for reducing a gap during the throw-off operation. A method is also provided.

4 Claims, 9 Drawing Sheets

U.S. PATENT DOCUMENTS

| | | | | |
|---|---|---|---|---|
| 5,161,463 | A | 11/1992 | Knauer et al. | 101/220 |
| 5,237,920 | A | 8/1993 | Guaraldi | 101/216 |
| 5,241,905 | A | 9/1993 | Guaraldi et al. | 101/216 |
| 5,245,923 | A | 9/1993 | Vrotacoe | 101/217 |
| 5,289,770 | A | 3/1994 | Hern | 101/226 |
| 5,301,609 | A | 4/1994 | Guaraldi et al. | 101/216 |
| 5,304,267 | A | 4/1994 | Vrotacoe | 156/86 |
| 5,316,798 | A | 5/1994 | Tittgemeyer | 427/409 |
| 5,323,702 | A | 6/1994 | Vrotacoe | 101/217 |
| 5,337,664 | A | 8/1994 | Hannon | 101/218 |
| 5,394,797 | A | 3/1995 | Doebler et al. | 101/216 |
| 5,415,092 | A | 5/1995 | Hern | 101/226 |
| RE34,970 | E | 6/1995 | Tittgemeyer | 101/141 |
| 5,421,260 | A | 6/1995 | Doebler | 101/247 |
| 5,429,048 | A | 7/1995 | Gaffney et al. | 101/217 |
| 5,440,981 | A | 8/1995 | Vrotacoe et al. | 101/217 |
| 5,481,972 | A | 1/1996 | Schmid | 101/216 |
| 5,488,903 | A | 2/1996 | Koebler et al. | 101/375 |
| 5,492,062 | A | 2/1996 | Harris et al. | 101/486 |
| 5,505,127 | A | 4/1996 | Knauer | 101/218 |
| 5,522,316 | A | 6/1996 | Singler | 101/479 |
| 5,524,539 | A | 6/1996 | Doebler | 101/247 |
| 5,535,674 | A | 7/1996 | Vrotacoe et al. | 101/216 |
| 5,535,675 | A | 7/1996 | Gentle | 101/248 |
| 5,546,859 | A | 8/1996 | Hern | 101/226 |
| 5,553,541 | A | 9/1996 | Vrotacoe et al. | 101/217 |
| 5,560,292 | A | 10/1996 | Knauer | 101/216 |
| 5,595,115 | A | 1/1997 | Rau et al. | 101/142 |
| 5,651,314 | A | 7/1997 | Gentle | 101/248 |
| 5,653,428 | A | 8/1997 | Dufour et al. | 270/6 |
| 5,671,636 | A | 9/1997 | Gagne et al. | 74/409 |
| 5,678,485 | A | 10/1997 | Guaraldi | 101/247 |
| RE35,646 | E | 11/1997 | Guaraldi et al. | 101/216 |
| 5,683,202 | A | 11/1997 | Hummel et al. | 403/325 |
| 5,699,735 | A | 12/1997 | Stein et al. | 101/219 |
| 5,718,175 | A * | 2/1998 | Guaraldi et al. | 101/477 |
| 5,746,132 | A | 5/1998 | Parks et al. | 101/483 |
| 5,768,990 | A | 6/1998 | Vrotacoe et al. | 101/217 |
| 5,771,804 | A | 6/1998 | Knauer et al. | 101/183 |
| 5,782,182 | A | 7/1998 | Ruckmann et al. | 101/177 |
| 5,794,529 | A | 8/1998 | Dawley et al. | 101/216 |
| 5,802,975 | A | 9/1998 | Prem et al. | 101/375 |
| 5,813,336 | A | 9/1998 | Guaraldi et al. | 101/218 |
| 5,832,821 | A | 11/1998 | Petersen et al. | 101/216 |
| 5,894,796 | A | 4/1999 | Gelinas | 101/219 |
| 5,901,648 | A | 5/1999 | Roland et al. | 101/218 |
| 5,960,714 | A | 10/1999 | Gottling et al. | 101/216 |
| 5,970,870 | A | 10/1999 | Shiba et al. | 101/137 |
| 5,979,371 | A | 11/1999 | Lewis | 122/494 |
| 6,019,039 | A | 2/2000 | Knauer et al. | 101/218 |
| 6,032,579 | A | 3/2000 | Richards | 101/219 |
| 6,038,975 | A | 3/2000 | Hoffmann et al. | 101/375 |
| 6,041,707 | A | 3/2000 | Petersen et al. | 101/232 |
| 6,050,185 | A | 4/2000 | Richards | 101/142 |
| 6,050,190 | A | 4/2000 | Knauer et al. | 101/216 |
| 6,053,105 | A | 4/2000 | Rudzewitz | 101/477 |
| 6,082,724 | A | 7/2000 | Kahlig et al. | 270/52.14 |
| 6,085,651 | A * | 7/2000 | Defrance et al. | 101/247 |
| 6,093,139 | A | 7/2000 | Belanger | 493/353 |
| 6,109,180 | A | 8/2000 | Guaraldi et al. | 101/466 |
| 6,148,684 | A | 11/2000 | Gardiner | 74/440 |
| 6,175,775 | B1 | 1/2001 | Grunder | 700/111 |
| 6,186,064 | B1 | 2/2001 | Dufour | 101/181 |
| 6,205,926 | B1 * | 3/2001 | Dufour | 101/492 |
| 6,216,592 | B1 | 4/2001 | Knauer et al. | 101/247 |
| 6,227,110 | B1 | 5/2001 | Zlatin | 101/218 |
| 6,227,111 | B1 | 5/2001 | Dawley et al. | 101/218 |
| 6,289,805 | B1 | 9/2001 | Douillard et al. | 101/247 |
| 6,343,547 | B1 | 2/2002 | Callahan et al. | 101/216 |
| 6,345,574 | B1 | 2/2002 | Charette et al. | 101/180 |
| 6,360,664 | B1 | 3/2002 | Goettling et al. | 101/481 |
| 6,374,731 | B1 | 4/2002 | Walczak et al. | 101/142 |
| 6,374,734 | B1 | 4/2002 | Gaffney et al. | 101/376 |
| 6,386,100 | B1 | 5/2002 | Gaffney et al. | 101/142 |
| 6,397,743 | B1 | 6/2002 | Dauer et al. | 101/220 |
| 6,397,751 | B1 | 6/2002 | Ramsay | 101/477 |
| 6,460,457 | B1 * | 10/2002 | Ramsay | 101/477 |
| 6,494,135 | B1 | 12/2002 | Goettling et al. | 101/213 |
| 6,494,138 | B1 | 12/2002 | Goettling et al. | 101/479 |
| 6,520,083 | B2 | 2/2003 | Petersen et al. | 101/401.1 |
| 6,526,888 | B2 | 3/2003 | Douillard et al. | 101/484 |
| 6,543,352 | B1 | 4/2003 | Dilling et al. | 101/220 |
| 6,553,908 | B1 | 4/2003 | Richards et al. | 101/248 |
| 6,557,467 | B1 | 5/2003 | Dilling et al. | 101/220 |
| 6,615,726 | B2 | 9/2003 | Douillard et al. | 101/483 |
| 6,647,876 | B2 | 11/2003 | Emery et al. | 101/247 |
| 6,739,251 | B2 | 5/2004 | Gaffney et al. | 101/217 |
| 6,820,547 | B2 | 11/2004 | Fujiwara | 101/218 |
| 6,937,751 | B2 | 8/2005 | Ritt et al. | 382/132 |
| 6,966,258 | B2 | 11/2005 | Charette et al. | 101/180 |
| 6,986,305 | B2 | 1/2006 | Knauer | 101/220 |
| 7,032,510 | B2 | 4/2006 | Christel et al. | 101/216 |
| 2002/0033105 | A1 | 3/2002 | Charette et al. | 101/220 |
| 2002/0078840 | A1 | 6/2002 | Gaffney et al. | 101/217 |
| 2004/0083911 | A1 | 5/2004 | Fujiwara | 101/247 |
| 2004/0206257 | A1 | 10/2004 | Gaffney et al. | 101/217 |
| 2004/0237817 | A1 | 12/2004 | Rauh | 101/218 |
| 2005/0160933 | A1 | 7/2005 | Ruschkowski | 101/425 |

FOREIGN PATENT DOCUMENTS

| | | | |
|---|---|---|---|
| DE | 3543704 | A1 | 6/1987 |
| DE | 3716188 | A1 | 12/1987 |
| DE | 4138479 | A1 | 6/1993 |
| DE | 4337554 | A1 | 6/1994 |
| DE | 4412873 | A1 | 11/1994 |
| DE | 9018111 | U | 6/1995 |
| DE | 4408025 | A1 | 9/1995 |
| DE | 4435429 | A1 | 4/1996 |
| DE | 19501243 | A1 | 7/1996 |
| DE | 4143597 | C2 | 6/1998 |
| DE | 19903847 | A1 | 8/2000 |
| DE | 19919272 | A1 | 11/2000 |
| DE | 10013979 | A1 | 12/2000 |
| DE | 10008936 | A1 | 8/2001 |
| EP | 0225509 | A2 | 6/1987 |
| EP | 0388740 | B1 | 9/1990 |
| EP | 0421145 | B2 | 4/1991 |
| EP | 0549936 | A1 | 7/1993 |
| EP | 0581019 | B1 | 2/1994 |
| EP | 0596244 | A1 | 5/1994 |
| EP | 0644048 | A2 | 3/1995 |
| EP | 0683043 | B1 | 11/1995 |
| EP | 0685335 | B1 | 12/1995 |
| EP | 0697284 | B1 | 2/1996 |
| EP | 0741015 | B1 | 11/1996 |
| EP | 0749927 | B1 | 12/1996 |
| EP | 0782920 | B1 | 7/1997 |
| EP | 0813958 | B1 | 12/1997 |
| EP | 0813959 | B1 | 12/1997 |
| EP | 0845352 | A1 | 6/1998 |
| EP | 0862999 | B1 | 9/1998 |
| EP | 0956951 | B1 | 11/1999 |
| EP | 0958917 | B1 | 11/1999 |
| EP | 0995595 | B1 | 4/2000 |
| EP | 1075943 | A1 | 2/2001 |
| EP | 1075944 | B1 | 2/2001 |
| EP | 1075945 | A1 | 2/2001 |
| EP | 1132202 | B1 | 9/2001 |
| EP | 1155825 | A2 | 11/2001 |
| EP | 1167028 | A2 | 1/2002 |
| FR | 2787059 | | 6/2000 |
| GB | 2149149 | A | 6/1985 |
| GB | 2 273 464 | | 6/1995 |

| | | | | |
|---|---|---|---|---|
| GB | 2309668 | A | | 8/1997 |
| JP | 63-236651 | | | 10/1988 |
| JP | 06270393 | A | * | 9/1994 |
| WO | WO 03/000496 | A1 | | 1/2003 |
| WO | WO 03/084757 | A1 | | 10/2003 |

OTHER PUBLICATIONS

Harris Corporation, The Harris M-112 and M-122: Profits through Automation, pp. 1-4.

Jochen Pagenberg; Johannes Lang, Le Droit Allemand Des Brevets Et Des Modeles D'Utilite.

Von Marcel Jacomet, Regeln und Steuem mit unscharfer Logik; pp. 94+.

Goss Sunday 2000 Automatic Transfer Provides Exclusive Zero-Makeready Advantages, Oct. 18, 2004 www.members.what-theythink.com/allsearch/article.cfm?id=17971&printer=pr.

Goss bietet Null-Rustzeiten-Vorteil, Oct. 2004, www.druckspiegel.de/archiv/news/2004/10/news.html.

Goss Sunday 2000 Automatic Transfer provides exclusive zero-makeready advantages, Oct. 10, 2004 www.gossintemational.com/index.php?src=news&prid=21&category=Commerical . . . .

Heidelberg Introduces Web Offset Makeready Breakthrough, Feb. 6, 2004, pp. 1-3.

Web Offset, Issue No. 55, pp. 1-16, Published by Goss International Corporation 2004.

Rotoman S Printing Unit, 2005. www.man-roland.de/en/popups/pw0118/w0011/index.jsp.

* cited by examiner

WEB OFFSET PRINTING PRESS WITH ARTICULATED TUCKER

This application claims priority to U.S. Provisional Patent Application No. 60/666,439 filed Mar. 30, 2005, and hereby incorporated by reference herein.

BACKGROUND

The present invention relates generally to printing presses and more specifically to web offset printing presses having separable blankets.

U.S. Pat. No. 4,240,346 describes for example a printing press with two blanket cylinders separable from each other to permit a blanket throw off. In such presses, the blankets are offset from a vertical from each other, and in order to pass the web through the blankets when the blankets are offset, lead rolls or air bars are necessary to properly guide the web through the blankets. These guides can mark the printed product and also alter registration of the web between two printing print units, causing deteriorated print quality.

U.S. Pat. No. 6,439,117, hereby incorporated by reference herein, discloses a printing press having a multi-plate plate cylinder which permits for independent removal of each printing plate while the other printing plates remain attached. The press also includes a tucker bar adjacent the lock-up bar, the tucker bar including at least a first segment for tucking and holding the first printing plate on the plate cylinder and a second segment for tucking and holding the second printing plate on the plate cylinder, the first segment being independently movable with respect to the second segment.

U.S. Pat. No. 6,595,135, hereby incorporated by reference herein, discloses a printing unit with a plate cylinder having an axially extending gap. A tucker bar has an operating position, the tucker bar in the operating position capable of tucking a tail end of a printing plate into the axially-extending gap. A tucker bar control device automatically moves the tucker bar away from the operating position to a non-operating position.

U.S. Pat. Nos. 6,216,592 and 6,019,039 describe printing units with throw-off mechanisms and are hereby incorporated by reference herein.

SUMMARY OF THE INVENTION

A fixed tail tucker assembly may guard the plate-to-blanket nip while the press is running and through the range of print cylinder positions from on-impression to off-impression. The tuckers are positioned for tail tucking when the print cylinders are in the plating position.

In an auto-transfer print unit, the on-impression to off-impression displacement of the print cylinders is increased. In the off-impression position, the distance between a traditional tucker and plate cylinder may be 30 mm. This larger gap allows access to the plate-to-blanket nip. However, gaps of 6 mm are preferable to prevent fingers from being caught between the plate and the blanket for example.

By providing an articulating tucker, the plate-to-blanket nip of an auto-transfer print unit is guarded throughout the entire motion of the print cylinders. An assembly of linkages fixed to the frame and plate cylinder box move the tail tucker as the cylinders are thrown on and off impression. The motion of the tail tucker maintains a minimum gap throughout the motion of the print cylinders.

The present invention provides an offset web print unit comprising:

a plate cylinder;

a blanket cylinder; the plate cylinder being movable during a throw-off operation a tucker bar for tucking plates into the plate cylinder, the tucker bar having an axis movable with respect to the plate cylinder axis for reducing a gap during the throw-off operation.

The present invention also provides a method for moving a tucker bar comprising throwing off a plate cylinder from a blanket cylinder; and moving the tucker bar axis with respect to a plate cylinder axis during throw-off to maintain a minimum gap.

BRIEF DESCRIPTION OF THE DRAWINGS

Preferred embodiments of the present invention will be elucidated with reference to the drawings in which.

DETAILED DESCRIPTION OF A PREFERRED EMBODIMENT

Figure 1:
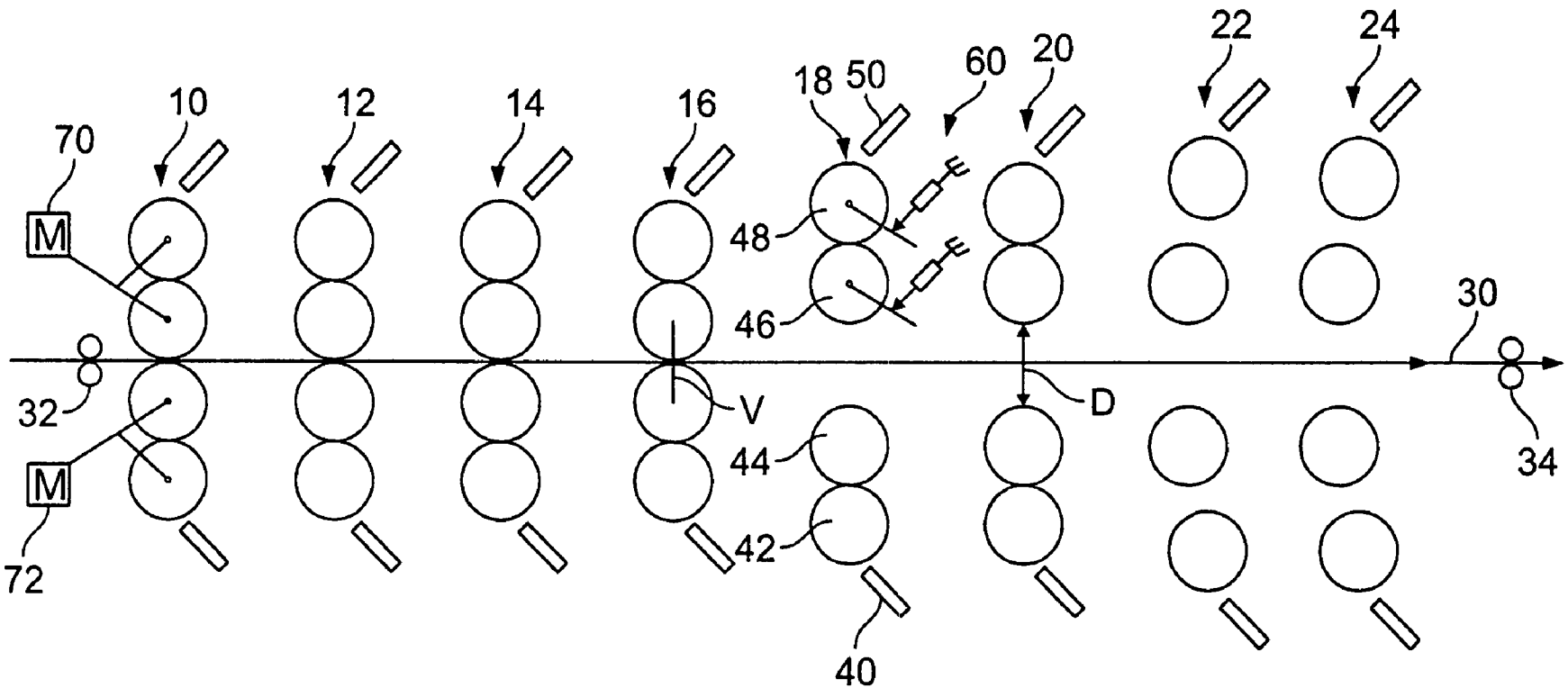
FIG. 1 shows a web offset printing press.

FIG. 1 shows a web offset printing press having eight offset print units 10, 12, 14, 16, 18, 20, 22, 24, each having a plate cylinder 42, blanket cylinder 44, plate cylinder 48 and blanket cylinder 46. Blanket cylinders 44 and 46 nip a web 30 in a printing mode, as shown for print units 10, 12, 14, 16, which may print black, cyan, yellow and magenta, respectively for example. The web may enter the print units via nip rollers 32 (which may be infeed rollers for example) and may exit via exit rollers 34, which may for example be located downstream of a dryer.

The blanket cylinders 44, 46 for each print unit may be thrown-off, as shown for units 22 and 24, so as to separate from each other and from the respective plate cylinder 42, 48. Plate cylinders 42, 48 may move back into contact with the blanket cylinders 44, 46, respectively, during an automatic plate change operation, for example via automatic plate changers 40 and 50, respectively. Automatic plate changers are described in U.S. Pat. Nos. 6,053,105, 6,460,457 and 6,397,751 and are hereby incorporated by reference herein.

A throw-off mechanism 60 is shown schematically for moving the blanket and plate cylinders 46, 48. Blanket cylinder 44 and plate cylinder 42 may have a similar throw-off mechanism. Preferably, each print unit is driven by two motors 70, 72, one driving one of the plate or blanket cylinders 46, 48, and one driving one of the plate cylinder 42 and blanket cylinder 44. The non-driven cylinder may be geared to the driven cylinder on each side of web 30. Each print unit 10, 12 . . . 24 may be the same.

The web path length between the nip rollers 32, 34 advantageously need not change, even when one of the print units has blanket cylinders which are thrown off. Registration may be unaffected by the throw-off. In addition, no web deflectors or stabilizers are needed, such as lead rolls or air rolls to make sure the web does not contact the blanket cylinders 44, 46, which could cause marking.

The throw-off distance D preferably is at least 0.5 inches and most preferably at least 1 inch, i.e. that the web has half an inch clearance on either side of the web. Moreover, the centers of the blanket cylinders 44, 46 preferably are in a nearly vertical plane V, which is preferably 10 degrees or less from perfect vertical. This has the advantage that the throw-off provides the maximum clearance for a horizontally traveling web.

The circumference of the plate cylinder preferably is less than 630 mm, and most preferably is 578 mm.

Figure 2:
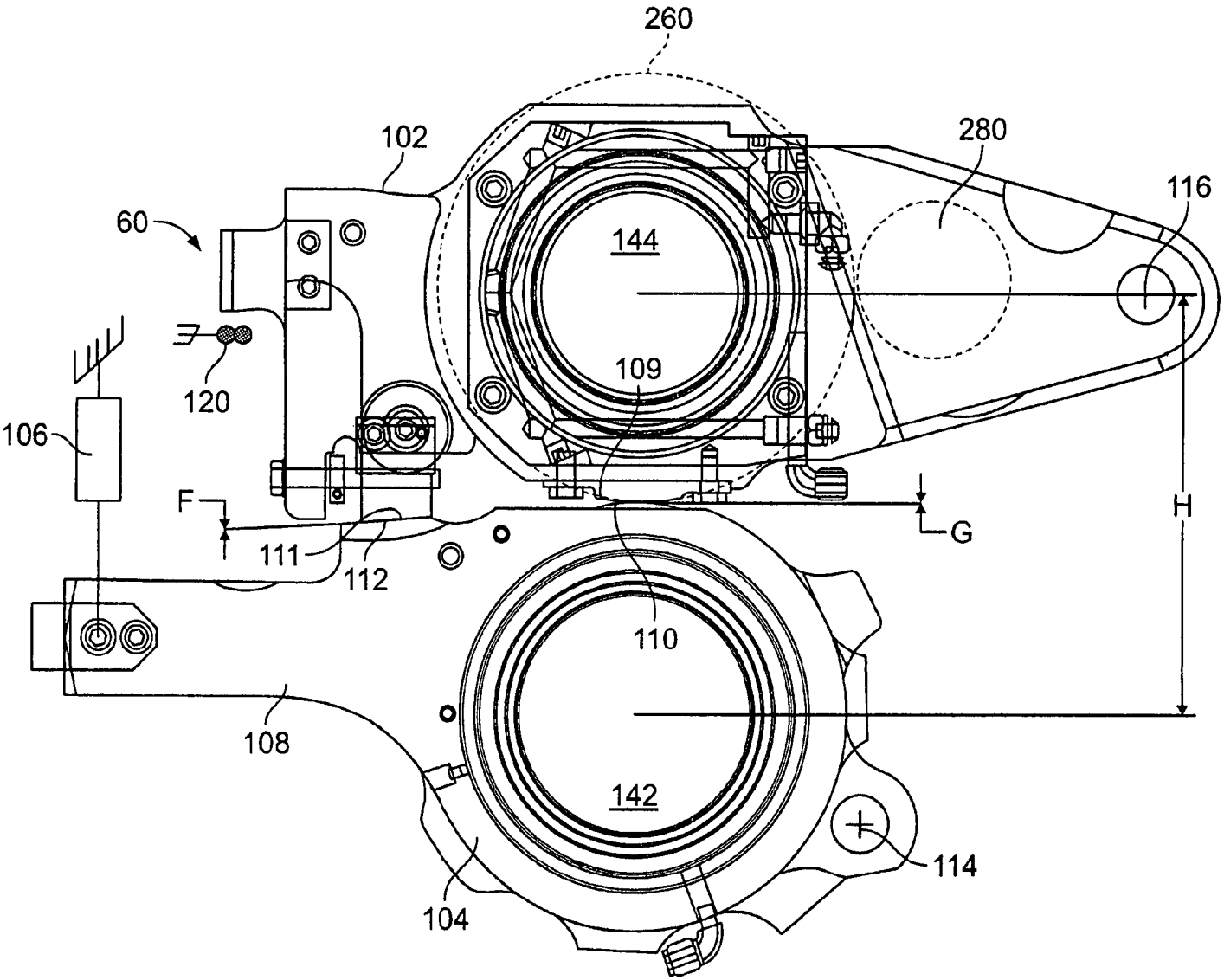
FIG. 2 shows bearer cams in a first printing position.

The creation of the large throw-off distance D is explained with an exemplary embodiment as follows:

FIG. 2 shows the throw-off mechanism 60 for the lower blanket cylinder 44. A blanket cylinder support 102 supports a gear side axle 144 of the blanket cylinder 44 and a plate cylinder support 104 supports a gear side axle 142 of the plate cylinder 42. The blanket cylinder support 102 is pivotable about an axis 116, and the plate cylinder support about an axis 114. A pneumatic cylinder 106 can move the plate cylinder support 104 via an arm 108.

When blanket cylinder 44 is in contact with blanket cylinder 46 in a printing position, a first bearer surface 111 of support 102 is in contact with a second bearer surface 112 of support 104, which another bearer surface 109 of the support 102 is not in contact with a bearer surface 110 of support 104. Distance F thus is zero, while a distance G between surfaces 109 and 110 may be 0.0045 inches. Distance H between the axial centers of the axles 144 and 142 may be 7.2463 inches.

Figure 3:
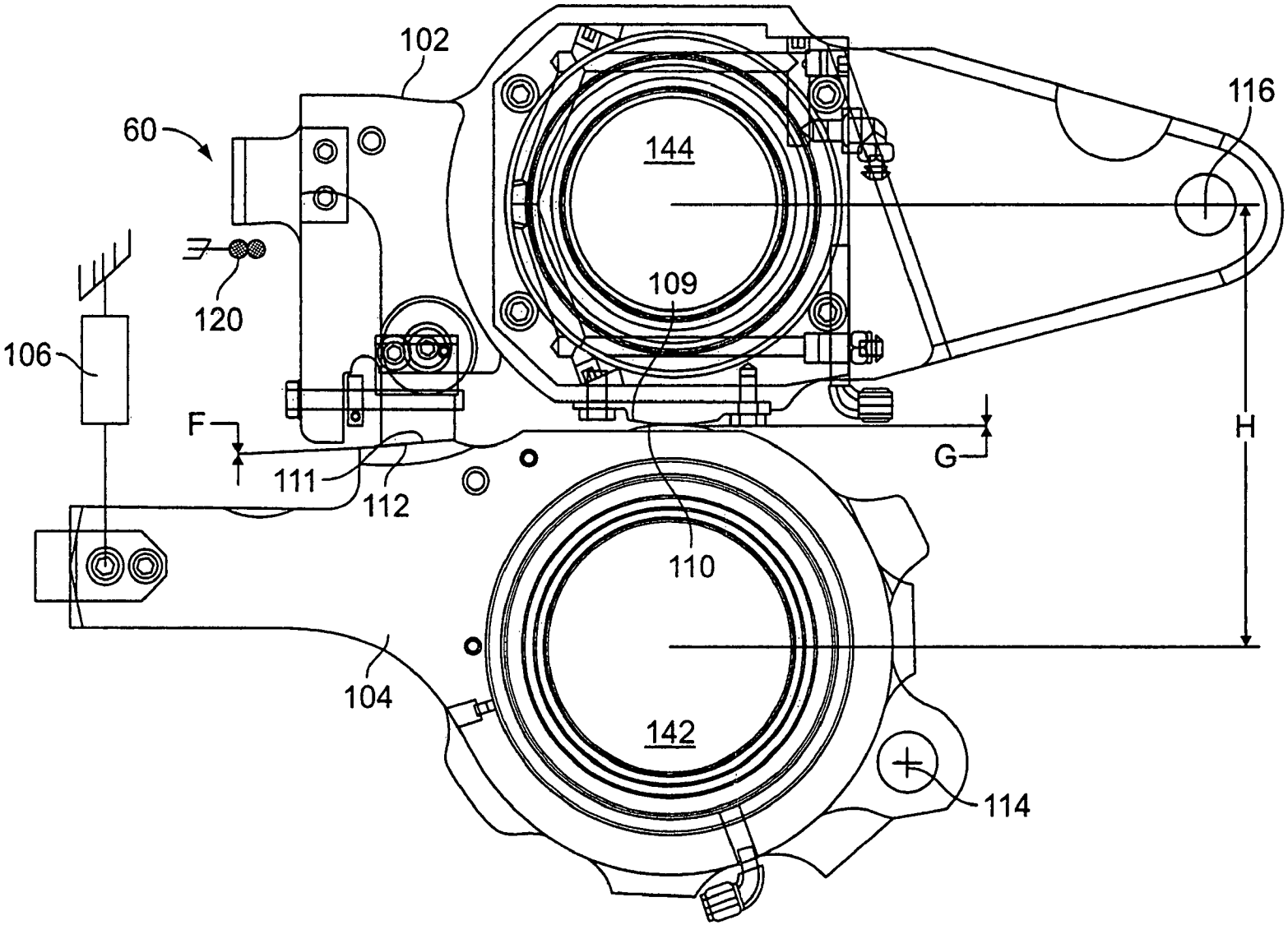
FIG. 3 shows bearer cams in a transition position.

In FIG. 3, support 104 is moved downwardly so distance H may be for example 7.2416 inches, and the distances F and G both are zero. The cam surfaces 111, 112 and 109, 110 thus are transitioning the load between themselves.

Figure 4:
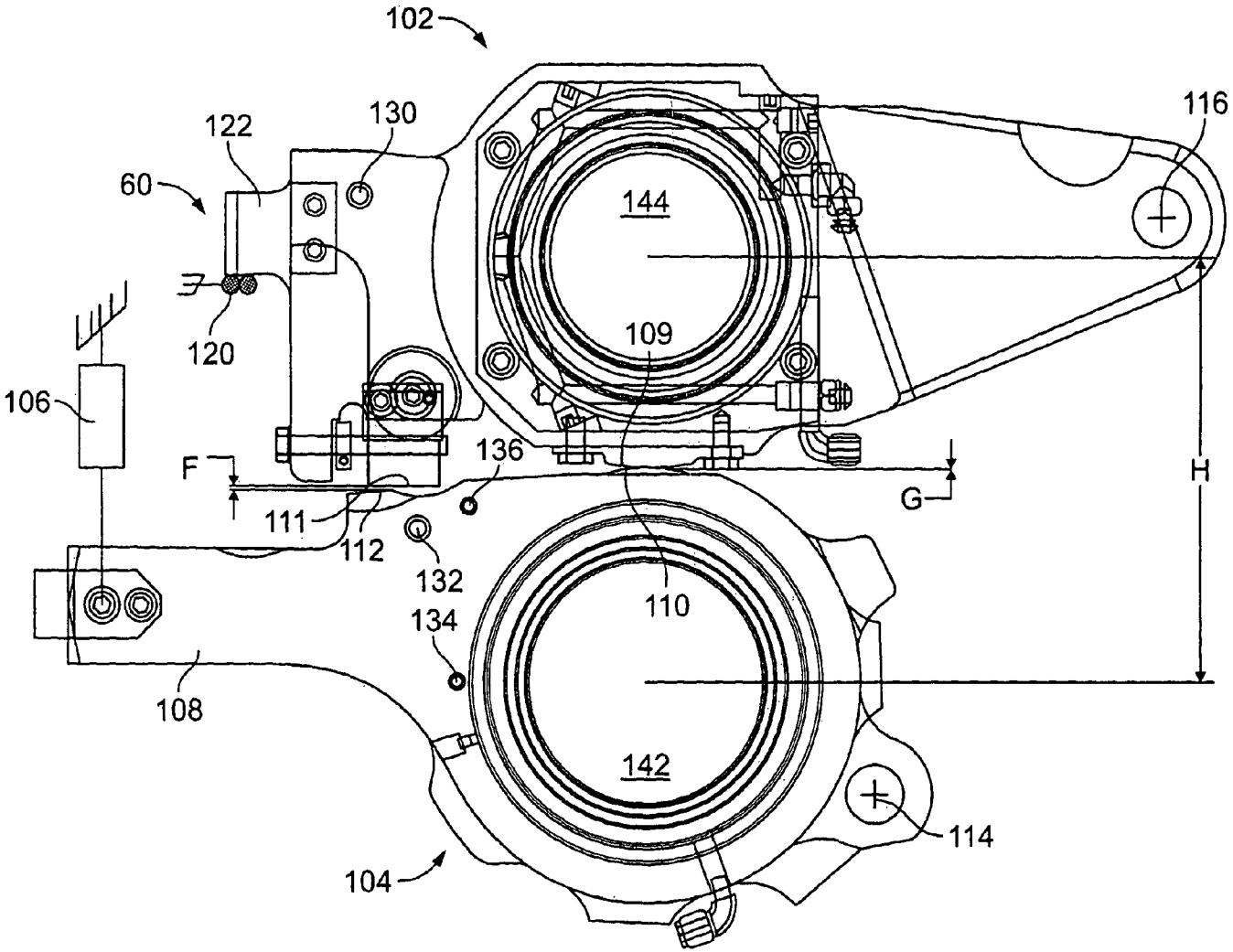
FIG. 4 shows bearer cams in a first throw-off position with the plate and blanket cylinders in contact.

As shown in FIG. 4, when support 104 moves downwardly more, blanket cylinder 44 is thrown-off the blanket cylinder 46, bearer surface or cam 109 of support 102 contacts bearer surface 110 of the box 104 so that the blanket cylinder box 102 rests on the box 104 at surfaces 109/110. A distance between the bearer surface 111 of box 102 and a bearer surface 112 of box 104 may be 0.1561 inches. The bearer surface 109 may have a same arc of curvature as blanket cylinder 44, and bearer surface 110 may have a same arc of curvature as plate cylinder 42, so that even in FIG. 4 distance H still remains 7.2416 inches. At this point an extension 122 also just comes into contact with a fixed stop 120 on a frame.

Figure 5:
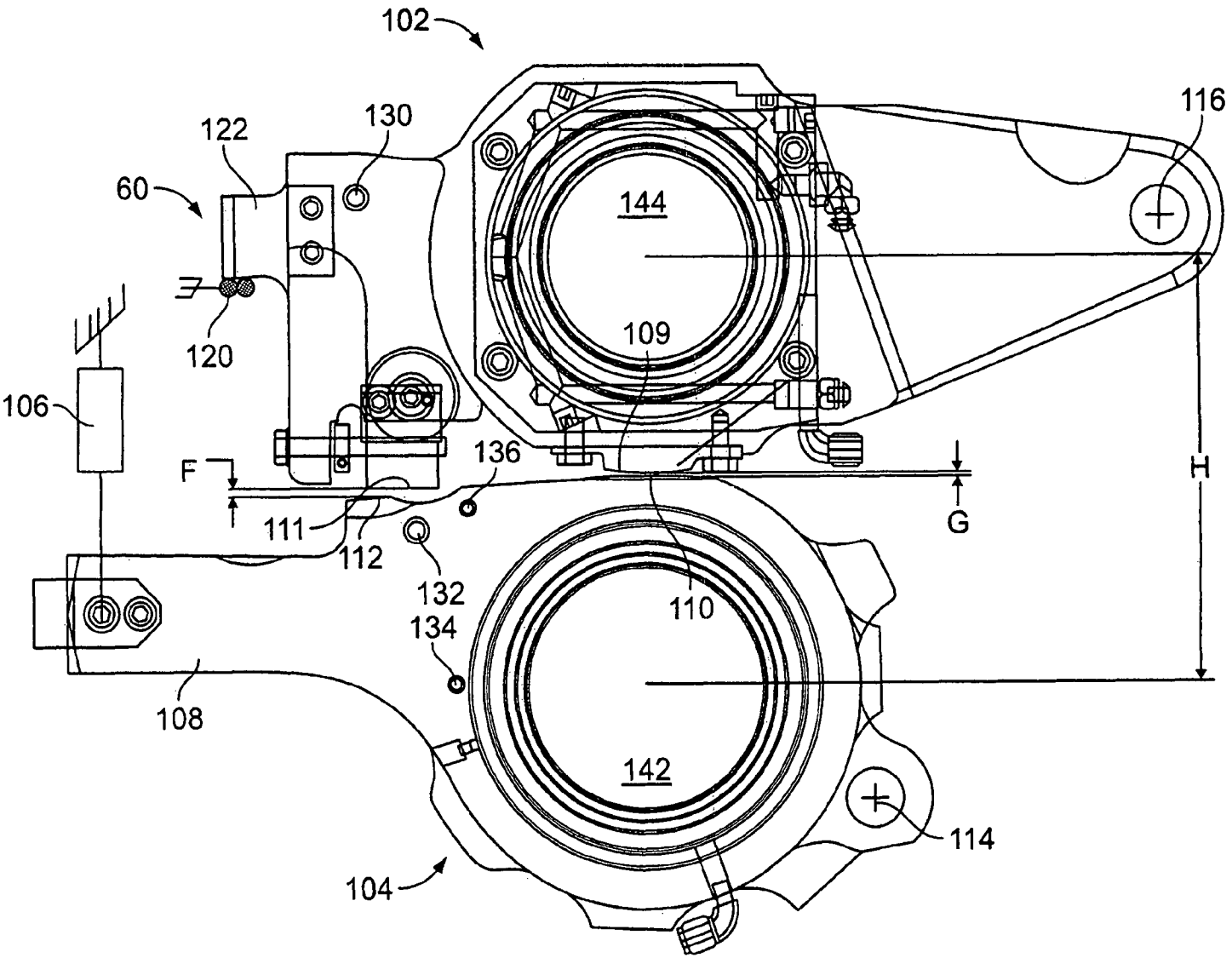
FIG. 5 shows bearer cams in a second throw-off position with the plate and blanket cylinders out of contact.

As shown in FIG. 5, when support 104 is moved downwardly more, blanket support 102 rests on stop 120 while plate support 104 moves downwardly even more. Thus, distance G between bearer surfaces 109 and 110 increases and may be 1 mm, for example. Distance F also increases. In this position, access to plate cylinder 42 for removing or changing a plate may be possible. For autoplating, the plate cylinder 42 may be moved again against the blanket cylinder 44 as in FIG. 4, if the autoplating mechanism so requires.

The upper plate and blanket throw-off mechanism may move in a similar manner with dual bearer surfaces, but since the gravity effects differ, a link may be provided between holes 130, 132 so that the raising of the plate cylinder 48 also causes the blanket cylinder 46 to rise.

As shown in FIG. 2, a drive gear 280 may drive a blanket cylinder gear 260. The blanket cylinder gear 260 may drive a similar plate cylinder gear. These gears 280, 260 may be axially inside the support 102, i.e. into the page. Due to the tangential arrangement of the gears, the rotation of the support 102 does not cause the gear 260 to disengage from gear 280 (which has an axis which does not translate). In the FIG. 2, 3, 4, and 5 positions, the blanket cylinder gear 260 and an interacting plate cylinder gear can be driven by gear 280. The motor 72 thus can be used for auto-plating.

As shown in FIG. 4, a tucker mechanism 302 for the plate cylinder 42 may be attached at holes 136, 134 of support 104.

Figure 6:
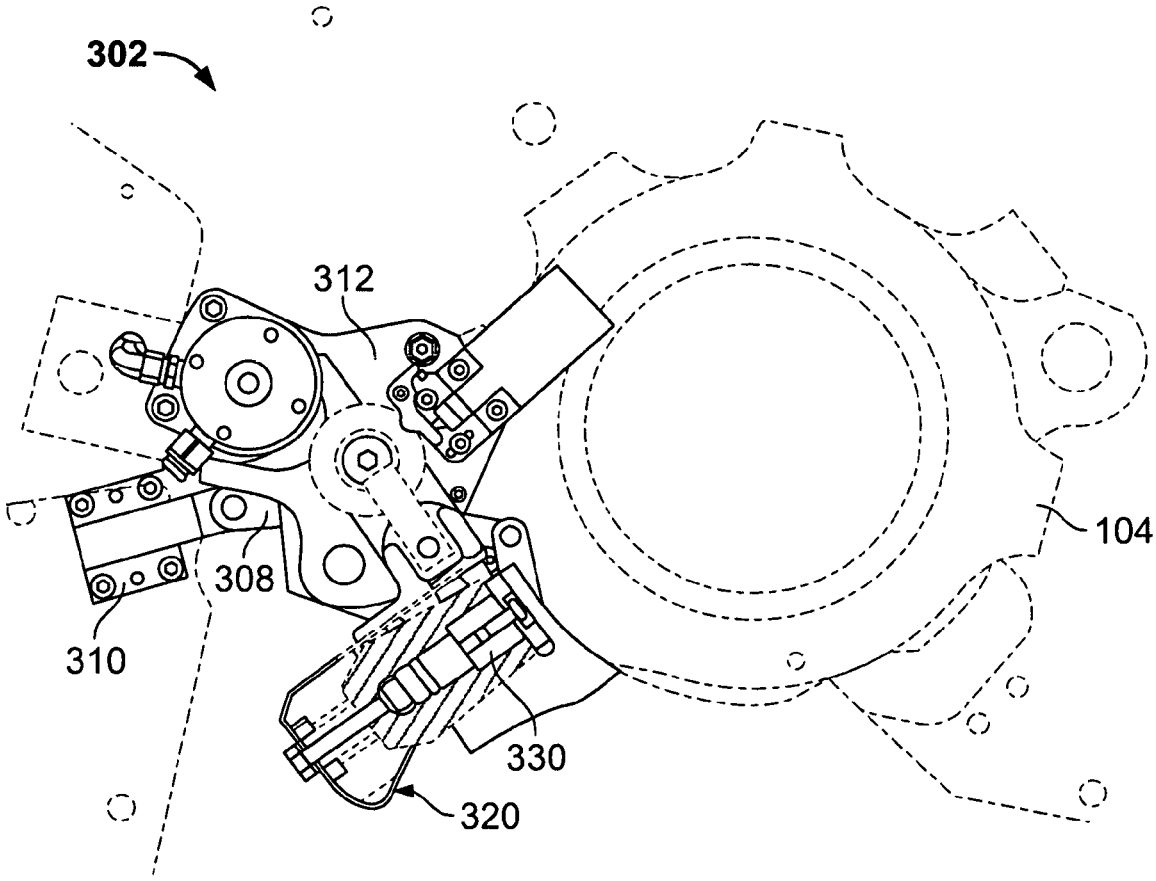
FIG. 6 shows a side view of the tucker of an automatic plate change device.
Figure 7:
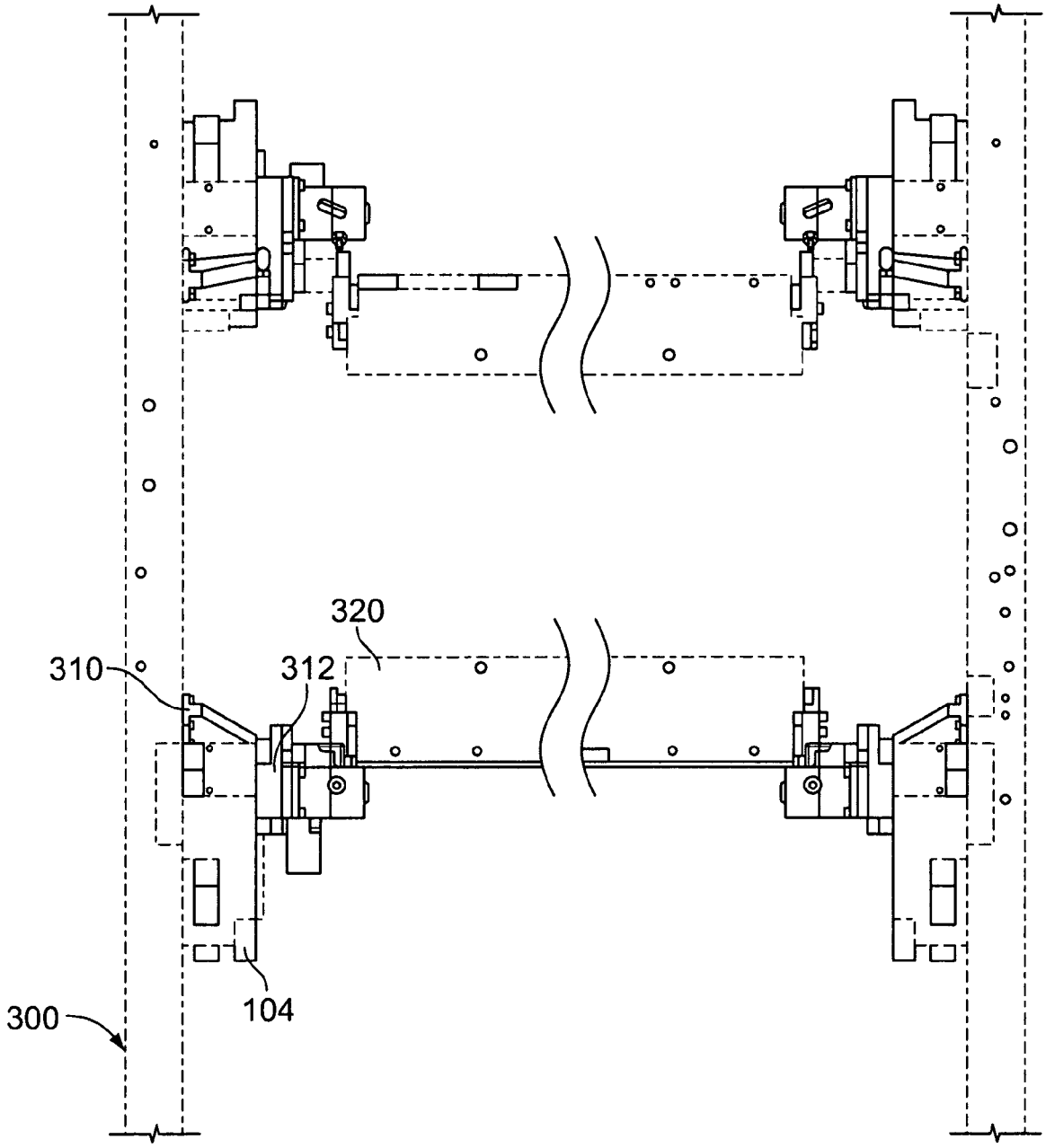
FIG. 7 shows an end view of the tuckers of the present invention.
Figure 8:
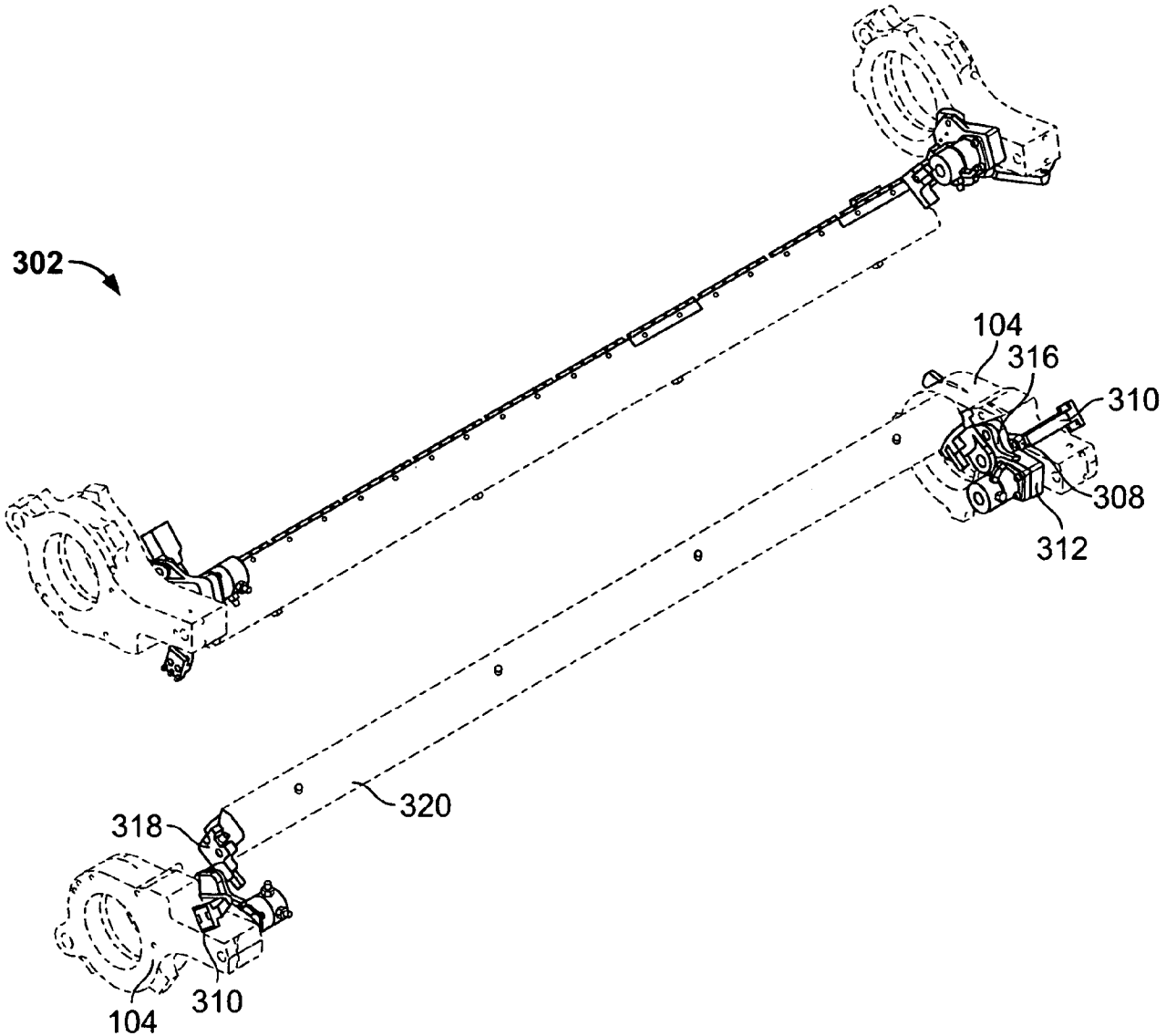
FIG. 8 shows a perspective view of the tuckers of the present invention.

FIGS. 6, 7 and 8 show the tucker mechanism 302 of the present invention. When large throw-off distances occur, the distance between a traditional tucker and the plate cylinder can be a gap of 30 mm. However, gaps of 6 mm are preferable, to prevent fingers from being caught between the plate and the blanket for example.

The tucker mechanism 302 thus includes a tucker bar 320 with tuckers 330, the tucker bar 320 being rotatingly supported via a tucker support plate 312 on the plate support 104. An arm 308, fixed to a frame 300 via a plate 310 as shown in FIG. 7, causes the support plate 312 to rotate when the plate support 104 is moved by cylinder 106 (FIG. 4) and causes the tucker bar 320 to maintain a minimum gap between the tucker bar 320 and the plate cylinder 42, for example 6 mm, throughout the entire motion of plate cylinder 42.

Figure 9:
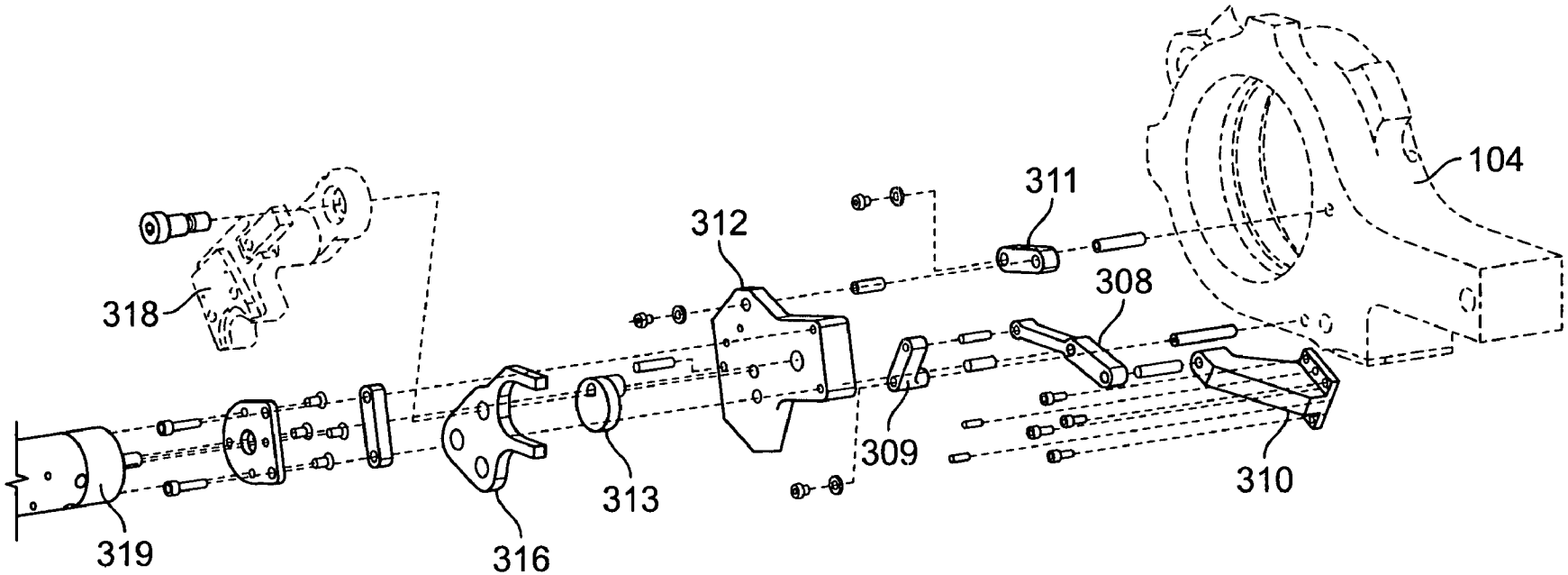
FIG. 9 shows an exploded view of the tucker connections.

As shown in FIG. 8, tucker mechanism 302 includes a tucker bar 320 with tuckers 330 shown in FIG. 6. Tucker bar 320 is rotatingly supported by a tucker support plate 312 via forks piece 316 and a tucker bar connector 318. Arm 308 and link 309 connect as shown in FIG. 9. Tucker support plate 312 is connected to plate support 104 via a link 311 and arm 308.

A pivot cam 313 fits in fork 316 and can be used to rotate the tucker bar via an air cylinder 319.

For the articulating motion, pneumatic cylinder 106 (FIG. 4) causes plate support 104 to move which causes arm 308 to rotate about fixed plate 310 since arm 308 is connected to support 104 via link 309 as shown in FIG. 9. Arm 308 causes support plate 312 to rotate or articulate about link 311, and plate 312 thus moves tucker bar 320 via tucker bar connector 318 so tucker bar 320 maintains a minimum gap between tucker bar 320 and plate cylinder 44, for example 6 mm, throughout the entire motion of plate cylinder 42 during throw-off.

What is claimed is:

1. A method for moving a tucker bar comprising the steps of:

throwing off a plate cylinder from a blanket cylinder; and moving the tucker bar axis with respect to a plate cylinder axis during throw-off to maintain a constant minimum gap between the tucker bar and the plate cylinder throughout.

2. The method as recited in claim 1 wherein the minimum gap is 6 millimeters or less.

3. The method as recited in claim 1 wherein the tucker bar guards a nip between the plate cylinder and the blanket cylinder.

4. The method as recited in claim 1 wherein the step of moving the tucker bar axis includes using a pneumatic cylinder to move a plate support, the plate support moving an arm causing the tucker support plate to rotate.

* * * * *